US009752573B2

(12) United States Patent
Hoehn et al.

(10) Patent No.: US 9,752,573 B2
(45) Date of Patent: Sep. 5, 2017

(54) PENDULUM SLIDE PUMP WITH AT LEAST ONE COMMUNICATION CHANNEL

(71) Applicant: Mahle International GmbH, Stuttgart (DE)

(72) Inventors: Dieter Hoehn, Hildburghausen (DE); Christian Richter, Schleusingen (DE); Michael Sahr, Sachsenbrunn (DE); Mark Tepler, Schleusingen (DE)

(73) Assignee: Mahle International GmbH (DE)

( * ) Notice: Subject to any disclaimer, the term of this patent is extended or adjusted under 35 U.S.C. 154(b) by 254 days.

(21) Appl. No.: 14/570,593

(22) Filed: Dec. 15, 2014

(65) Prior Publication Data

US 2015/0167666 A1 Jun. 18, 2015

(30) Foreign Application Priority Data

Dec. 16, 2013 (DE) ..... 10 2013 226 110

(51) Int. Cl.
*F03C 4/00* (2006.01)
*F04C 2/00* (2006.01)
(Continued)

(52) U.S. Cl.
CPC ..... *F04C 2/332* (2013.01); *F01C 1/322* (2013.01); *F01C 1/332* (2013.01); *F01C 1/336* (2013.01);
(Continued)

(58) Field of Classification Search
CPC ..... F01C 1/322; F01C 1/332; F01C 21/0863; F01C 21/0809; F01C 21/0845;
(Continued)

(56) References Cited

U.S. PATENT DOCUMENTS 2,064,635 A 12/1936 Stern
3,869,231 A * 3/1975 Adams ..... F01C 21/0863 418/268
8,708,679 B2 * 4/2014 Mathers ..... F01C 21/0863 418/268
2005/0281690 A1 12/2005 Ide et al.
(Continued)

FOREIGN PATENT DOCUMENTS

DE 4434430 A1 3/1996
DE 19532703 C1 11/1996
(Continued)

OTHER PUBLICATIONS

English Abstract for DE 4434430.
(Continued)

*Primary Examiner* — Theresa Trieu
(74) *Attorney, Agent, or Firm* — Fishman Stewart PLLC

(57) ABSTRACT

A pendulum slider pump may include an inner rotor connected via a plurality of pendulums to an outer rotor. The pendulums may be mounted on the outer rotor in an articulated manner, and the pendulums may respectively include a pendulum foot guiding in an associated radial groove arranged in the inner rotor. The radial grooves may each include a groove base and two circumferentially spaced groove walls. The outer rotor, the inner rotor and two pendulums adjacent in a circumferential direction may each delimit a chamber. Each pendulum foot together with the associated groove walls and the groove base may delimit a pendulum foot space. At least one pendulum foot space may be connected to the associated chamber via at least one communication channel. The at least one communication channel may open into the pendulum foot space in a region of the groove base.

20 Claims, 1 Drawing Sheet

(51) Int. Cl.

| | |
|---|---|
| ***F04C 18/00*** | (2006.01) |
| ***F04C 2/332*** | (2006.01) |
| ***F01C 1/32*** | (2006.01) |
| ***F04C 2/32*** | (2006.01) |
| ***F01C 1/332*** | (2006.01) |
| ***F01C 1/336*** | (2006.01) |
| ***F04C 14/22*** | (2006.01) |
| ***F04C 15/00*** | (2006.01) |

(52) U.S. Cl.

CPC ..... *F04C 2/322* (2013.01); *F04C 14/22* (2013.01); *F04C 14/226* (2013.01); *F04C 15/0065* (2013.01); *F04C 2230/102* (2013.01); *F04C 2230/21* (2013.01); *F04C 2230/22* (2013.01)

(58) Field of Classification Search

CPC ..... F04C 2/3446; F04C 2/322; F04C 2/328; F04C 2/332; F04C 2/356; F04C 18/59; F04C 14/22; F04C 14/226; F04C 15/0065; F04C 2230/22; F04C 2230/00; F04C 18/46

USPC ..... 418/173, 259, 266–268, 75, 77, 82

See application file for complete search history.

(56) References Cited

U.S. PATENT DOCUMENTS

| | | | | |
|---|---|---|---|---|
| 2012/0034110 | A1 | 2/2012 | Dreifert et al. | |
| 2012/0082582 | A1* | 4/2012 | Richter ..... | F04C 2/332 418/173 |

FOREIGN PATENT DOCUMENTS

| | | | |
|---|---|---|---|
| DE | 10155869 | A1 | 5/2003 |
| DE | 10334672 | B3 | 1/2005 |
| DE | 102005027439 | A1 | 1/2006 |
| DE | 102009018212 | A1 | 10/2010 |
| EP | 0117720 | A2 | 9/1984 |
| EP | 0601218 | A1 | 6/1994 |

OTHER PUBLICATIONS

English Abstract for EP 0601218.

Search Report for EP Application No. 14196538.4. dated Mar. 20, 2015, 3 pp.

English abstract for DE-19532703.

English abstract for DE-10334672.

English abstract for DE-10155869.

* cited by examiner

PENDULUM SLIDE PUMP WITH AT LEAST ONE COMMUNICATION CHANNEL

CROSS-REFERENCE TO RELATED APPLICATIONS

This application claims priority to German Patent Application No. 10 2013 226 110.1, filed Dec. 16, 2013, the contents of which are hereby incorporated by reference in their entirety.

TECHNICAL FIELD

The present invention relates to a pendulum slider pump with an inner rotor, which is connected to an outer rotor via pendulums, according to the preamble of claim 1.

BACKGROUND

From DE 103 34 672 B3 a generic pendulum slider pump is known with which out of a torque that is present on the driveshaft the delivery action of a displacement pump can be achieved with an eccentric orbital movement. In a single or multiple-part housing a cylindrical working chamber is arranged, on the lateral surface of which at least five socket grooves arranged distributed over the circumference are located, in which the heads of pendulum webs are arranged. On the seat of the eccentric a pressure ring provided with pendulum grooves is rotatably arranged, wherein below the pendulum grooves of the pressure ring in the foot region passage flow openings directed both towards the suction kidney as well as to the pressure kidney are arranged. By way of this, the control, in particular of an inlet and outlet in working chambers, is to be simplified.

From DE 195 32 703 C1 a further pendulum slider pump with minimised inertia is known, which comprises a rotating inner rotor and a displaceably mounted outer rotor which co-rotates by way of pendulums. For the eccentrically displaceable outer rotor to be rotatably driven by the inner rotor only one pendulum at a time is in sliding contact with its driving head, driving foot and only one sliding flank. The mating contour or second sliding flank of the pendulum is contactlessly guided in grooves. The cross section of a driving head of the pendulum is smaller than that of the driving foot, as a result of which a previously unfavourably high mass located radially outside can now be reduced and because of this the inertia likewise reduced.

Disadvantageous with the pendulum slider pumps known from the prior art however is that with these a pendulum foot space, i.e. a space that is delimited by two groove walls and one groove base of the inner rotor and the associated pendulum foot cannot be filled or emptied or only with difficulty so. Because of this, fluid, in particular oil, collects in the pendulum foot space under certain conditions, as a result of which a dynamic stagnation pressure is built up which changes or influences the eccentricity of the outer rotor relative to the inner rotor in an uncontrolled manner and because of this renders exact controlling of the rate of delivery of the pendulum slider pump difficult.

SUMMARY

The present invention therefore deals with the problem of stating an improved or at least an alternative embodiment for a pendulum slider pump of the generic type, in which the disadvantages known from the prior art do not occur.

According to the invention, this problem is solved through the subject of the independent claim. Advantageous embodiments are subject of the dependent claims.

The present invention is based on the general idea of providing a communication channel between a pendulum foot space and an associated chamber located outside, which reliably prevents the built-up of a dynamic stagnation pressure in the pendulum foot space and which at the same time is designed or arranged so that it does not negatively influence guiding the pendulum in an associated radial groove of an inner rotor of the pendulum slider pump. Here, the pendulum slider pump according to the invention has in the said inner rotor, which is connected via pendulums to an outer rotor. The pendulums are mounted on the outer rotor in an articulated manner and simultaneously guided with their pendulum foot in radial grooves in the inner rotor. The outer rotor, the inner rotor as well as two pendulums adjacent in circumferential direction accordingly delimit a pressure/suction chamber (pressure/suction kidney) each of the pendulum slider pump. Furthermore, the pendulum foot together with two groove walls and a groove base delimits the previously described pendulum foot space, which according to the invention is now connected via the communication channel to a chamber located outside, for example the suction/pressure chamber and simultaneously opens into the pendulum foot space in the region of the groove base. Through the arrangement of the communication channel according to the invention, simple filling or emptying of the pendulum foot space with liquid, for example with oil, can be effected, as a result of which an undesirable dynamic stagnation pressure build-up that occurred in this region in the past can be reliably avoided. By avoiding the dynamic stagnation pressure, the eccentricity of the outer rotor relative to the inner rotor does not deviate from a set value in an undesirable manner either so that via the exactly controllable eccentricity the delivery volume of the pendulum slider pump according to the invention can also be exactly adjusted. For with conventional pendulum slider pumps known from the prior art the dynamic stagnation pressure which builds up in the pendulum foot space resulted in that the pendulums because of the incompressibility of the fluid present in the pendulum foot space were obstructed in their entry movement into the groove, as a result of which the eccentricity of the outer rotor relative to the inner rotor was enlarged in this angular range. This causes the chamber volume delimited by the outer rotor, the inner rotor and two pendulums adjacent in circumferential direction and thus also the rate of delivery of the pendulum slider cell pump. At the same time, a motor driving the pendulum slider pump has to battle the dynamic stagnation pressure, as a result of which increased drive power is required. Through the communication channel opening into the pendulum foot space in the region of the groove base provided according to the invention, a preferentially complete emptying of the pendulum foot space can be additionally ensured so that the pendulums are not obstructed in any way in their entry movement. In addition to this, the opening of the communication channel into the pendulum foot space at the base offers the great advantage that the groove walls of the groove guiding the respective pendulum are not otherwise impaired as a result of which low-friction and unimpeded guiding of the respective pendulum is possible.

In an advantageous further development of the solution according to the invention, a communication channel is provided for each pendulum foot space which in the direction of rotation is arranged in front of or after the associated pendulum. By differently arranging the communication channels the force conditions in the pump can be adapted to the specific application. Accordingly, with an arrangement in front of the associated pendulum the tendency towards limiting, i.e. a reduction of the eccentricity of the inner rotor, can be reduced. An advantageous operating state can thereby be achieved, which is characterized by particular stability. Depending on the application it is also conceivable to make possible especially easier limiting of the pump in that the communication channel is arranged after the associated pendulum in order for example to achieve easier adjustment of the eccentricity.

Practically, two communication channels are provided for each pendulum foot space which in direction of rotation are arranged in front of and after the associated pendulum. By providing two such communication channels particularly effective and easy emptying of the pendulum foot spaces can be effected since during an entry movement of the pendulum into the groove the fluid volume present in the pendulum foot space can be expelled via two communication channels. With such a pendulum slider pump the direction of rotation furthermore has no influence on the filling or emptying of the respective pendulum foot spaces so that it can be operated independently of the direction of rotation. Furthermore, neutral behaviour with respect to the force relationship in the pump thus results from the arrangement.

In a further advantageous embodiment of the solution according to the invention, the at least one communication channel is designed as a bore or as a groove and in this case closed off by a lid on the face end. Designing the communication channel as a bore offers the great advantage that the communication channel can be subsequently introduced into the inner rotor in a simple yet extremely exact manner. In the same way, the communication channel can also be formed as groove arranged on the face end on the respective inner rotor, which via a corresponding communication section communicates with the groove base of the respective pendulum foot space. In this case, the groove is formed in the inner rotor and the communication channel is formed by covering this groove by means of a lid.

Alternatively, the at least one communication channel can obviously be primarily formed, in particular by sintering or by a suitable casting core during casting. In the latter case, the casting core is washed out after casting, thereby leaving the communication channel behind. Sintering methods are also conceivable for producing the inner rotor or the communication channel. Eroding methods are also suitable in principle for producing the communication channel.

In a further advantageous embodiment of the solution according to the invention, the communication channel is embodied linear or curved. The linear embodiment offers the advantage of being able to produce the communication channel for example by means of simple drilling. A curved communication channel can for example take into account design particularities and be produced through eroding or during casting by inserting a suitable salt or sand core.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

Here it shows, in each case schematically.

DETAILED DESCRIPTION

Figure 1:
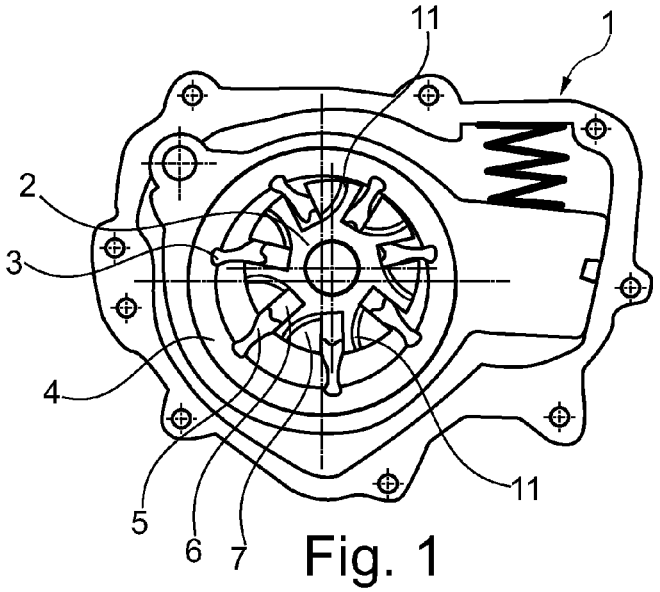
FIG. 1 a sectional representation through a pendulum slider pump according to the invention, FIG. 2 a detail representation of the pendulum slider pump with a curved communication channel, FIG. 3 a representation as in FIG. 2, however with a linear communication channel.

According to FIG. 1, a pendulum slider pump 1 according to the invention, which can for example be designed as an oil pump in a motor vehicle, comprises an inner rotor 2, which via pendulums 3 is connected to an outer rotor 4. Here, the pendulums 3 are mounted on the outer rotor 4 in an articulated manner and with their pendulum foot 5 guided in radial groove 6 in the inner rotor 2. For the articulated mounting the pendulums 3 comprise a pendulum head, which is mounted in a corresponding joint socket on the outer rotor 4. The outer rotor 4, the inner rotor 2 as well as two pendulums 3 adjacent in circumferential direction additionally delimit a chamber 7, which is formed as suction chamber or as pressure chamber depending on the rotary position. Considering the detail representation according to FIGS. 2 and 3 it is clearly evident from these in particular that the pendulum foot 5 together with two groove walls 8 and 8' and a groove base 9 delimit a pendulum foot space 10, which via a communication channel 11 (see FIGS. 1 to 3) is connected to an associated chamber 7, wherein the communication channel 11 opens into the pendulum foot space 10 in the region of the groove base 9.

Figure 2:
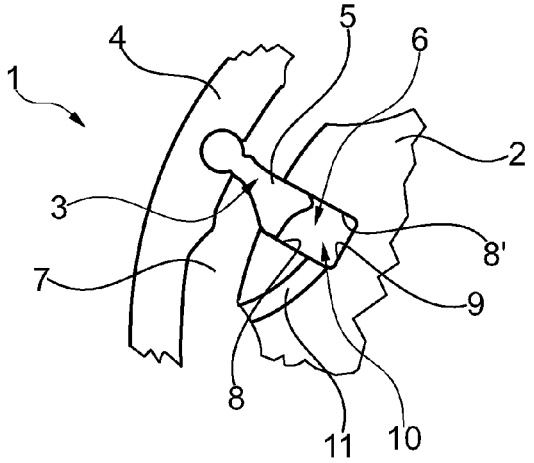
Figure 3:
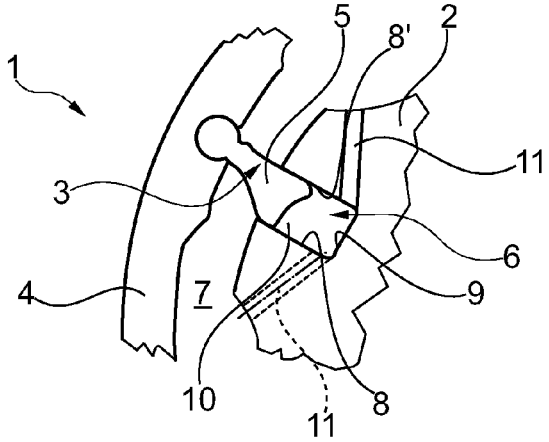

In the pendulum slider pumps 1 according to FIGS. 1 to 3, each pendulum foot space 10 is connected to the associated chamber 7 via a communication channel, wherein the communication channel 11 depending on the direction of rotation of the inner rotor 2 is arranged in front of or after the associated pendulum 3. Considering, by contrast, FIG. 3, it is evident with the help of the same that two communication channels 11 can also be provided for each pendulum foot space 10 in principle which are arranged in direction of rotation in front of and after the associated pendulum 3. According to FIG. 3, one of the two communication channels 11 is drawn with a continuous line and the other with an interrupted line.

With the communication channels 11 according to the invention, particularly simple and rapid filling or mainly emptying of the pendulum foot spaces 10 is possible, as a result of which undesirable dynamic stagnation pressure built-up within the pendulum foot space 10 can be effectively avoided. The built-up of a dynamic stagnation pressure is to be avoided in particular because the same makes it difficult or obstructs the entry movement of the respective pendulum 3 in the associated groove 6 and because of this influences the eccentricity of the outer rotor 4 relative to the inner rotor 2 in an undesirable manner. In the case of changed or undesirably influenced eccentricity the delivery characteristics of the pendulum slider pump 1 are also influenced. By providing the at least one communication channel 11 on each pendulum foot space 10 the build-up of this undesirable dynamic stagnation pressure can be reliably avoided. By providing the opening of the communication channel 11 in the region of the groove base 9 complete and simple emptying of the pendulum foot space 10 is additionally made possible and in addition to this none of the groove walls 8, 8' is influenced in such a manner that these can no longer assume guiding of the pendulum 3 in the desired manner. In Addition, by providing two communication channels 11 for each pendulum foot space 10 the draining and filling operation can be rendered even more quickly in addition, as a result of which a particularly smooth-operating pendulum slider pump 1 can be created.

Purely theoretically, the communication channel 11 can be formed as a groove and closed off by a face-end lid which is not shown. Alternatively it is also conceivable that the communication channel 11 is formed as a bore, as is shown for example according to FIG. 3. In this case, the communication channel is embodied linearly. Alternatively, the communication channel can also be embodied curved (see FIGS. 1 and 2), wherein in this case the communication channel 11 is produced for example through eroding or during casting by inserting a suitable casting core.

With the at least one communication channel 11 for each pendulum foot space 10 according to the invention, directed filling or emptying of the pendulum foot spaces 10 is made possible, in particular if merely one communication channel 11 for each pendulum foot space 10 is provided. Through the communication channel 11 according to the invention a tendency towards wear can also be reduced since the pendulum slider pump 1 no longer has to battle high dynamic stagnation pressures within the pendulum foot spaces 10. Through the opening of the communication channel 11 in the base of the respective groove 6, i.e. in the region of the groove base 9, no reduction of the frictional area of the pendulum 3 whatsoever occurs in the inner rotor 2, i.e. specifically on the groove walls 8, 8'.

The invention claimed is:

1. A pendulum slider pump, comprising:

an inner rotor having a rotation axis connected via a plurality of pendulums to an outer rotor;

the inner rotor including a plurality of radial grooves configured to receive the plurality of pendulums, the plurality of radial grooves each including a groove base and at least two circumferentially spaced groove walls;

the plurality of pendulums mounted on the outer rotor in an articulated manner, the plurality of pendulums respectively including a pendulum foot guided in a corresponding one of the plurality of radial groove;

a plurality of chambers each defined by the outer rotor, the inner rotor and two pendulums adjacent in a circumferential direction of the rotation axis;

a plurality of pendulum foot spaces defined in the plurality of radial grooves, wherein each of the plurality of pendulum foot spaces is delimited by the pendulum foot of the plurality of pendulums together with the at least two groove walls and the groove base of the plurality of radial grooves; and at least one communication channel provided for each of the plurality of pendulum foot spaces, wherein each communication channel is arranged in the inner rotor to fluidly connect an associated pendulum foot space of the plurality of pendulum foot spaces to a respective chamber of the plurality of chambers, and wherein each communication channel is structured at one end to open into the respective chamber and at another end to open into the associated pendulum foot space in a region of the groove base of each of the plurality of radial grooves.

2. The pendulum slider pump according to claim 1, wherein the at least one communication channel provided for at least one of the plurality of pendulum foot spaces is arranged with respect to a direction of rotation in front of the associated pendulum or after the associated pendulum.

3. The pendulum slider pump according to claim 1, wherein at least one of the plurality of pendulum foot spaces includes at least two communication channels arranged on opposite sides of an associated pendulum with respect to a direction of rotation, and wherein at least one of the at least two communication channels is arranged in front of the associated pendulum with respect to the direction of rotation and connected to one of the plurality of chambers, and at least one other of the at least two communication channels is arranged after the associated pendulum with respect to the direction of rotation and connected to another of the plurality of chambers.

4. The pendulum slider pump according to claim 1, wherein the at least one communication channel provided for at least one of the plurality of pendulum foot spaces includes at least one of a groove defined on a face end of the inner rotor and a bore.

5. The pendulum slider pump according to claim 1, wherein the at least one communication channel provided for at least one of the plurality of pendulum foot spaces is formed via at least one of a primary forming process and eroding.

6. The pendulum slider pump according to claim 1, wherein the at least one communication channel of the associated pendulum foot space for each of the plurality of pendulum foot spaces is fluidly separated from the at least one communication channel of each circumferentially adjacent pendulum foot space with respect to the rotation axis.

7. The pendulum slider pump according to claim 1, wherein each communication channel extends radially between the associated pendulum foot space and the corresponding chamber at least one of linearly and curved.

8. The pendulum slider pump according to claim 1, wherein the pendulum slider pump is an oil pump.

9. A motor vehicle, comprising:

at least one pendulum slider pump for supplying a fluid to at least one of an internal combustion engine and a transmission, the at least one pendulum slider pump including:

an inner rotor having a rotation axis connected to an outer rotor via a plurality of circumferentially spaced pendulums;

a plurality of radial grooves disposed on the inner rotor configured to receive the plurality of pendulums, the plurality of radial grooves each including at least two circumferentially spaced groove walls and a groove base disposed between the at least two groove walls;

the plurality of pendulums respectively including a pendulum head mounted on the outer rotor and a pendulum foot arranged in a corresponding one of the plurality of radial grooves;

a plurality of chambers each defined by the inner rotor, the outer rotor and two circumferentially adjacent pendulums;

a pendulum foot space associated with each of the plurality of radial grooves, wherein each pendulum foot space is delimited by each pendulum foot of the plurality of pendulums together with the at least two groove walls and the groove base of each of the plurality of radial grooves;

a plurality of communication channels disposed on the inner rotor, the plurality of communication channels including at least two communication channels provided for the pendulum foot space of at least one associated radial groove of the plurality of radial grooves, wherein the at least two communication channels are disposed on circumferentially opposite sides of the at least one associated radial groove with respect to the rotation axis, and the at least two communication channels are each arranged to fluidly connect the pendulum foot space of the at least one associated radial groove to a respective one of the plurality of chambers; and wherein at least one of the at least two communication channels extends radially from at least one of the at least two groove walls of the at least one associated radial groove to a respective chamber of the plurality of chambers and at least one other of the at least two communication channels extends radially from at least one other of the at least two groove walls of the at least one associated radial groove to another respective chamber of the plurality of chambers, and wherein the at least two communication channels respectively open into the pendulum foot space of the at least one associated radial groove at the groove base.

10. The motor vehicle according to claim 9, wherein the plurality of communication channels further includes at least one communication channel provided for the pendulum foot space of each associated one of the plurality of radial grooves, and wherein each pendulum foot space is fluidly connected to a corresponding one of the plurality of chambers via the at least one communication channel.

11. The motor vehicle according to claim 10, wherein the at least one communication channel provided for the pendulum foot space of each associated one of the plurality of radial grooves is fluidly separated from the at least one communication channel of each circumferentially adjacent pendulum foot space with respect to the rotation axis.

12. The motor vehicle according to claim 9, wherein the at least two communication channels connect the pendulum foot space of the at least one associated radial groove to circumferentially adjacent chambers with respect to the rotation axis separated from one another via a corresponding one of the plurality of pendulums.

13. The motor vehicle according to claim 9, wherein the at least one of the at least two communication channels is arranged in front of the associated pendulum with respect to a direction of rotation and the at least one other of the at least two communication channels is arranged after the associated pendulum with respect to the direction of rotation.

14. The motor vehicle according to claim 9, wherein the plurality of communication channels further includes at least two communication channels provided for the pendulum foot space of each of the plurality of radial grooves.

15. The motor vehicle according to claim 9, wherein the at least two communication channels include at least one of a groove defined on a face end of the inner rotor and a bore hole extending in the inner rotor.

16. The motor vehicle according to claim 9, wherein the at least two communication channels extends at least one of linearly and curved between the at least one associated radial groove and the respective one of the plurality of chambers.

17. The motor vehicle according to claim 9, wherein the at least two communication channels are each structured at one end to open into the respective one of the plurality of chambers and at another end to open into the pendulum foot space of the at least one associated radial groove at the groove base.

18. A pendulum slider pump, comprising:

an inner rotor having a rotation axis;

an outer rotor;

a plurality of pendulums connecting the inner rotor to the outer rotor;

the inner rotor including a plurality of radial grooves configured to receive the plurality of pendulums, the plurality of radial grooves each including a groove base and at least two circumferentially spaced groove walls;

the plurality of pendulums mounted on the outer rotor in an articulated manner, the plurality of pendulums respectively including a pendulum foot guided in a corresponding one of the plurality of radial grooves;

a plurality of chambers each defined by the outer rotor, the inner rotor and two pendulums adjacent in a circumferential direction of the rotation axis;

a plurality of pendulum foot spaces defined in the plurality of radial grooves, wherein each pendulum foot space is delimited by the pendulum foot of each of the plurality of pendulums together with the at least two groove walls and the groove base of each of the plurality of radial grooves;

an arrangement of communication channels disposed on the inner rotor, the arrangement of communication channels including at least one communication channel provided for each of the plurality of pendulum foot spaces;

wherein each communication channel of the arrangement of communication channels is disposed in the inner rotor to fluidly connect an associated pendulum foot space of each of the plurality of pendulum foot spaces to a respective one of the plurality of chambers, and wherein each communication channel of the arrangement of communication channels is structured at one end to open into the respective one of the plurality of chambers and at another end to open into the associated pendulum foot space at the groove base of each of the plurality of radial grooves.

19. The pendulum slider pump according to claim 18, wherein the at least one communication channel of the arrangement of communication channels provided for each of the plurality radial grooves is fluidly separated from the at least one communication channel of a circumferentially adjacent radial groove with respect to the rotation axis.

20. The pendulum slider pump according to claim 18, wherein the arrangement of communication channels further includes at least two communication channels provided for a respective pendulum foot space of at least one radial groove of the plurality of radial grooves, the at least two communication channels disposed on circumferentially opposite sides of the at least one radial groove and each arranged to fluidly connect the respective pendulum foot space to a separate chamber of the plurality of chambers, and wherein the at least two communication channels extend from the separate chambers to the at least one radial groove and open into the respective pendulum foot space at a respective corner defined by a corresponding one of that at least two groove walls and the groove base.

* * * * *